US005383766A

United States Patent [19]

Przirembel et al.

[11] Patent Number: 5,383,766

[45] Date of Patent: Jan. 24, 1995

[54] COOLED VANE

[75] Inventors: Hans R. Przirembel, Jupiter; Robert C. Meyer, Palm Beach Gardens, both of Fla.

[73] Assignee: United Technologies Corporation, Hartford, Conn.

[21] Appl. No.: 550,003

[22] Filed: Jul. 9, 1990

[51] Int. Cl.[6] ..... F01D 5/18

[52] U.S. Cl. ..... 416/97 A; 416/92

[58] Field of Search ..... 416/92, 96 A, 97 R, 416/97 A

[56] References Cited

U.S. PATENT DOCUMENTS 4,565,490 1/1986 Rice ..... 416/96 A
4,770,608 9/1988 Anderson et al. ..... 416/97 R

FOREIGN PATENT DOCUMENTS 148601 11/1981 Japan ..... 416/97 A
2202907 10/1988 United Kingdom ..... 416/96 R

*Primary Examiner*—Michael J. Carone
*Attorney, Agent, or Firm*—Norman Friedland

[57] ABSTRACT

A stator vane for a gas turbine engine wherein the airfoil section includes a plurality of pockets with an impingement hole at the upstream end of a passageway formed in the pocket and a slot formed on the opposite end of the pocket for discharging a film of cooling air along the outer surface of the air foil. The impingement hole and slot being arranged so that the flow of air in the passageway is in counterflow indirect heat exchange relationship with the gas path, thus placing the hottest part of the metal forming the pocket with the coolest air in the pocket.

7 Claims, 6 Drawing Sheets

COOLED VANE

The invention was made under a U.S. Government contract and the Government has rights herein.

CROSS REFERENCE

The subject matter of this application is related to the subject matter of commonly assigned U.S. patent application Ser. No. 550,008 (Attorney Docket No. F-6518) filed on even date herewith and entitled "Cooled Vane".

TECHNICAL FIELD

This invention relates to gas turbine engines and more particularly to the cooling aspects of the vane and other stator components.

BACKGROUND ART

The technical community working in gas turbine engine technology have and are continually expending considerable effort to improve the cooling aspects of the engine's component parts, particularly in the turbine area. Obviously, improving the effectiveness of the cooling air results in either utilizing less air for cooling or operating the engine at higher temperature. Either situation attributes to an improvement in the performance of the engine.

It is axiomatic that notwithstanding the enormous results and development that has occurred over the years the state-of-the-art film cooling and convection techniques are not optimum.

Some of the problems that adversely affect the cooling aspects particularly in vanes are (1) the pressure ratio across all of the film holes cannot be optimized and (2) in vanes that incorporate conventional inserts, the static pressure downstream of the insert is constant. Essentially in item (1) above the holes that operate with less than optimum pressure drop fail to produce optimum film cooling and in item (2) above a constant internal static pressure adversely affects internal convection.

One of the techniques that has been used with some degree of success is coating of the airfoil sections of the vanes with a well known thermal barrier coating. However, a coated vane conventionally requires drilling a cylindrical shaped film hole after the coating process by a laser. This compromises the film cooling potential effectiveness, thus consequently reducing the effectiveness of the vane. Moreover, flow control through the hole is more difficult, presenting additional problems to the engine designer.

We have found that we can obviate the problems noted above and improve the cooling effectiveness by providing in the vane a plurality of pockets each of which define a diffusing passageway and a metering slot adjacent the airfoil surface together with judiciously located holes associated with each pocket for feeding cooling air in the diffusing passageway to the slots which in turn effectively coalesce the air into a film of cooling air that flows across the external surface of the vane. In accordance with this invention the flow of the cooling air in the diffusion channel is in indirect counter flow heat exchange with the engine's gas path. This attains counter flow convection in the diffusing channel and effectively allows impingement cooling where the film air temperatures and metal temperatures are the hottest.

It is contemplated within the scope of this invention that the vane be fabricated from either a total casting process or a partial casting process where a structural inner shell is cast and a sheath formed from sheet metal encapsulates the shell.

A vane constructed in accordance with this invention affords amongst other advantages the following:

1) Using counterflow heat transfer, convection cooling potential is utilized more effectively than a parallel flowing design. (6.2% higher average cooling effectiveness).
2) Film cooling effectiveness is optimized.
3) The film cooling system can adapt to thermal barrier coatings and the like without film cooling compromise.
4) Convection is optimized since flow can be metered locally to heat-transfer requirements and over all pressure ratio.
5) In the sheet metal design a repair procedure can be accommodated where distressed panels can be replaced without scrapping the total part.
6) A pressure side or suction side panel of the designed vane may be optimized for both flow and film coverage.
7) Improved cooling is achieved with hole and slot sizes that are large enough to minimize internal plugging.
8) In the sheet metal configuration flexibility of material choices for the external shell is significantly increased.
9) In the fully cast configuration the vane can be cast in halves which offer the most versatility in terms of achieving desired cooling flows and film blowing parameters.

SUMMARY OF THE INVENTION

An object of this invention is to provide for a gas turbine engine improved cooling effectiveness for the engine's vanes and/or stator components.

A feature of this invention is to provide side walls that define the airfoil section of a vane having a plurality of pockets each having a diffusing passageway terminating in a slot for flowing film cooling air on the outer surface of the side wall and having judiciously located holes discreetly feeding cooling air into said pockets from a central passageway in the vane communicating with a source of cooling air so that the cooling air flow is in indirect counter flow heat relationship with the flow of the engine's gas path.

The foregoing and other features and advantages of the present invention will become more apparent from the following description and accompanying drawings.

BEST MODE FOR CARRYING OUT THE INVENTION

While in its preferred embodiment this invention is being utilized in the stator vane of the first stage turbine of a gas turbine engine, it will be understood by those skilled in this technology that the invention can be employed in other vanes and other static components without departing from the scope of this invention. Notwithstanding the fact that the preferred embodiment is a fully cast vane utilizing inserts, the partially cast embodiment or fully cast embodiment without inserts are all deemed to be within the scope of this invention.

Figure 1:
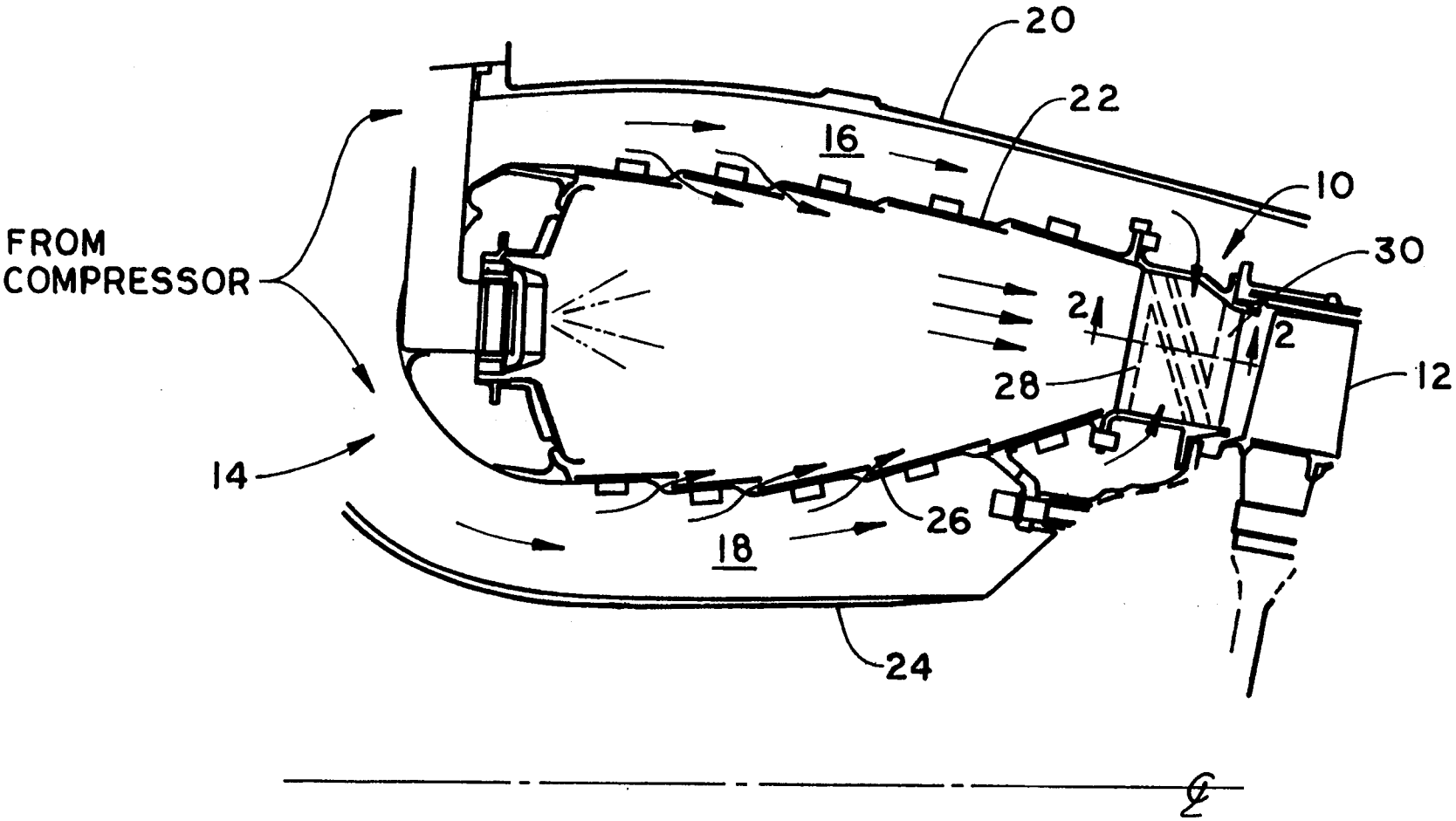
FIG. 1 (PRIOR ART)
FIG. 1 is a partial view in schematic of the combustor, 1st turbine and vane of a gas turbine engine exemplary of the prior art.
Figure 2:
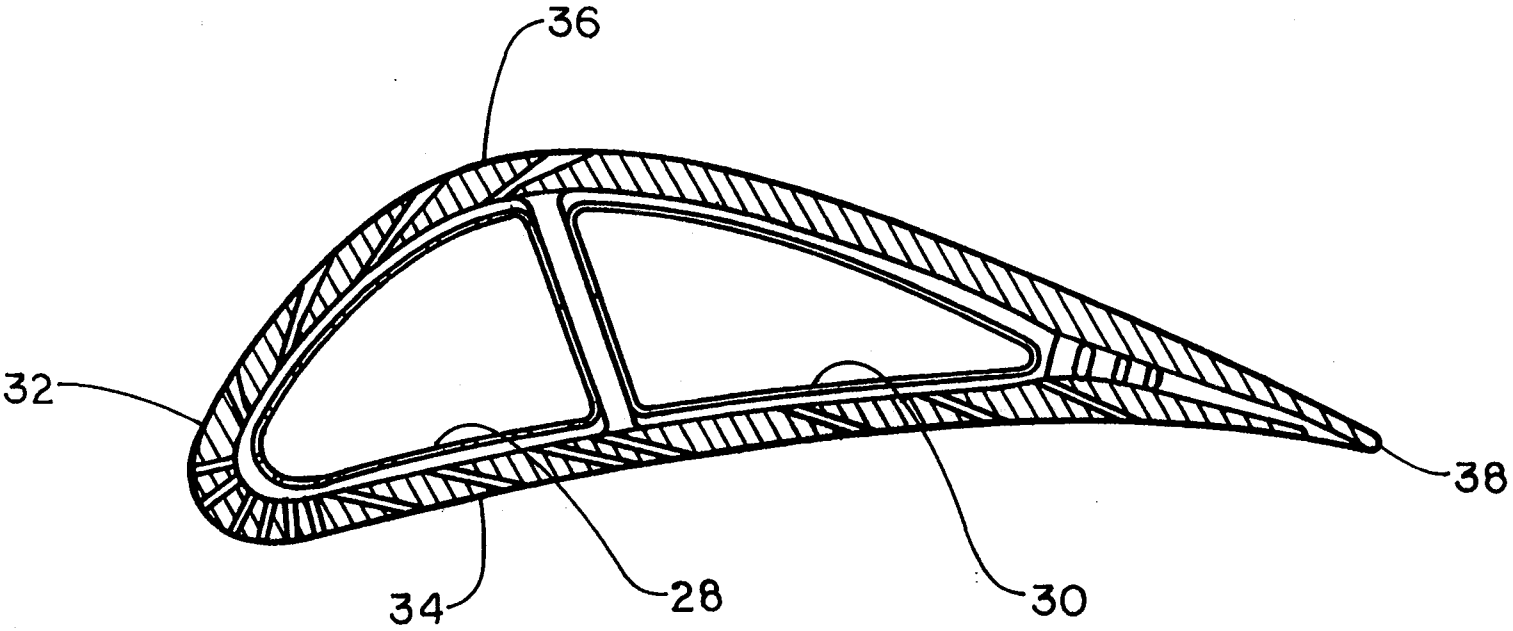
FIG. 2 (PRIOR ART)
FIG. 2 is a sectional view taken along lines 2—2 of FIG. 1 of a prior art vane.
Figure 3:
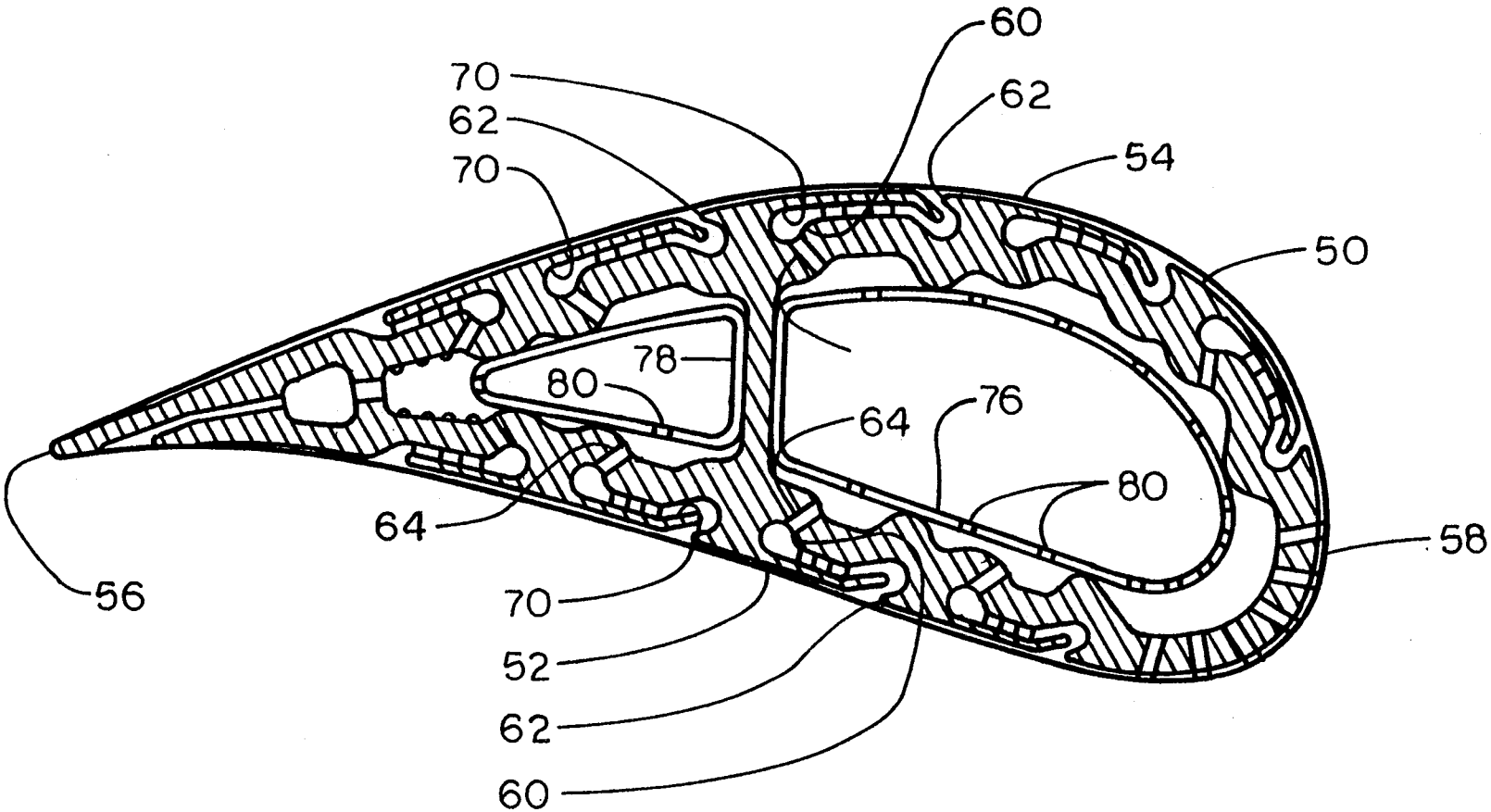
FIG. 3 is a sectional view of a vane made in accordance with this invention showing the details thereof.

The invention can perhaps be best understood by first having an understanding of the state-of-the-art vane exemplified by the prior art disclosed in FIGS. 1 and 2. As shown the vane generally indicated by reference numeral 10 is disposed between the first stage turbine rotor 12 and burner 14. The vane 10 is cooled by routing cool air obtained from the engine's compressor section (not shown) via the passageways 16 and 18 which is defined by the outer annular case 20 and outer liner 22 and inner annular case 24 and inner annular burner liner 26. Inserts 28 and 30 opened at its base distribute the cool air from passageways 16 and 18 through a plurality of holes formed in the walls thereof to a plurality of holes formed in the pressure surface, suction surface, trailing and leading edges. Typically, flow entering the insert or impingement tube circuit 28 from passageway 18 exits the vane as film air through film holes in the leading edge 32, the pressure surface 34 and the suction surface 36. Flow entering the insert or impingement tube circuit 30 from passageway 16 exits the vane as film air through film holes in the pressure surface 34 and suction surface 36 and as dump flow through holes in the trailing edge 38. Platforms 35 and 37 on the inner and outside diameter serve to attach the vane to the engine's turbine and combustor cases and are opened to the compressor air flow.

What has been described is conventional in available gas turbine engines such as the 9D, PW2037, PW4000 and F100 family of engines manufactured by Pratt and Whitney division of United Technologies Corporation, the assignee common with this patent application. For the sake of convenience and simplicity only that portion germane to the invention is described herein, and for further details the above noted engines are incorporated herein by reference. In the embodiments described like reference numerals refer to like or similar parts.

Figure 4:
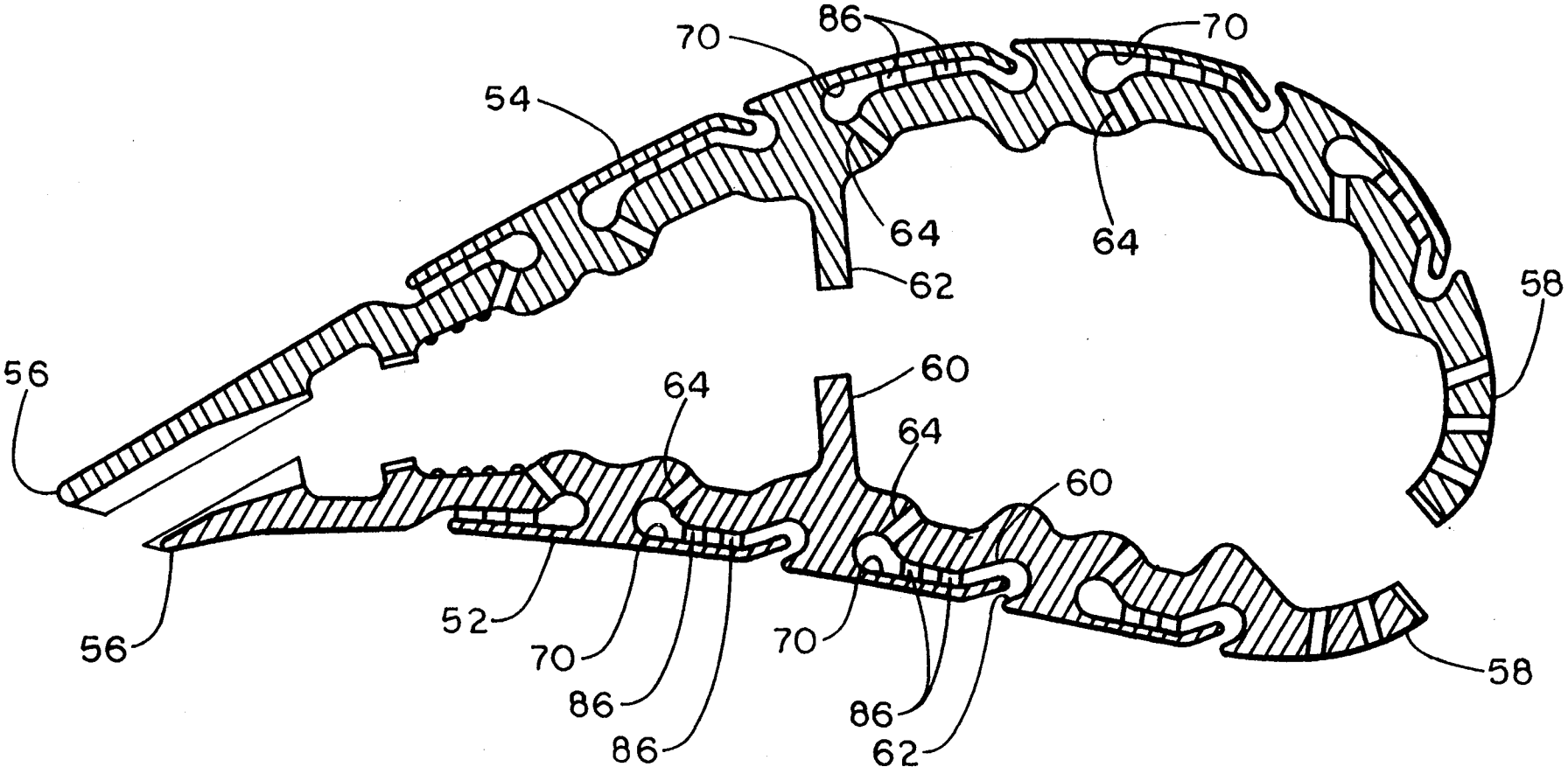
FIG. 4 is an exploded sectional view of fully cast airfoil halves of the inventive vane.
Figure 5:
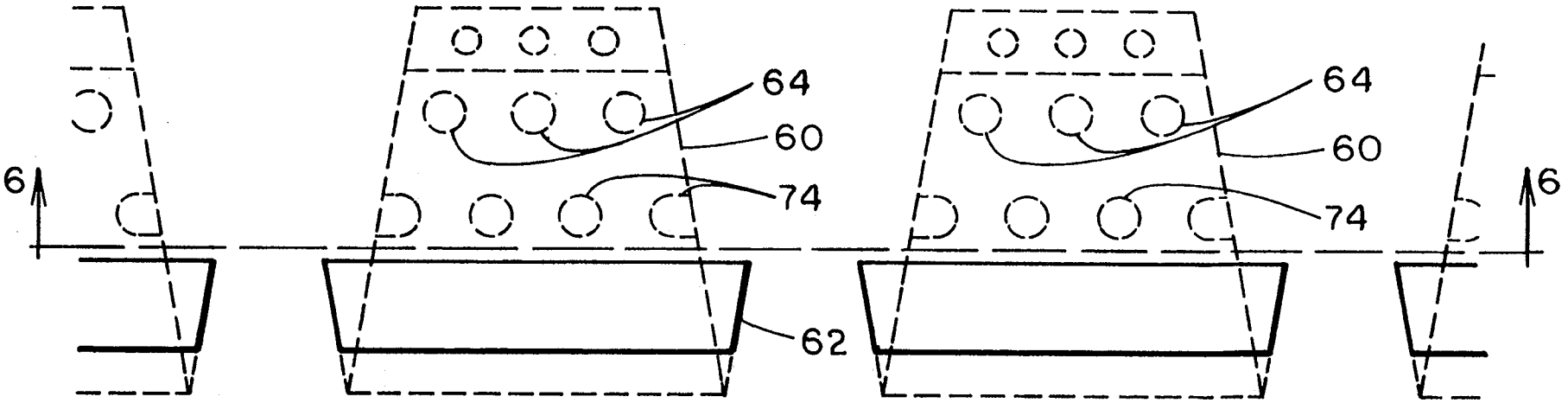
FIG. 5 is an enlarged view showing a portion of the pressure surface of the airfoil section of the vane in FIG. 3.
Figure 6:
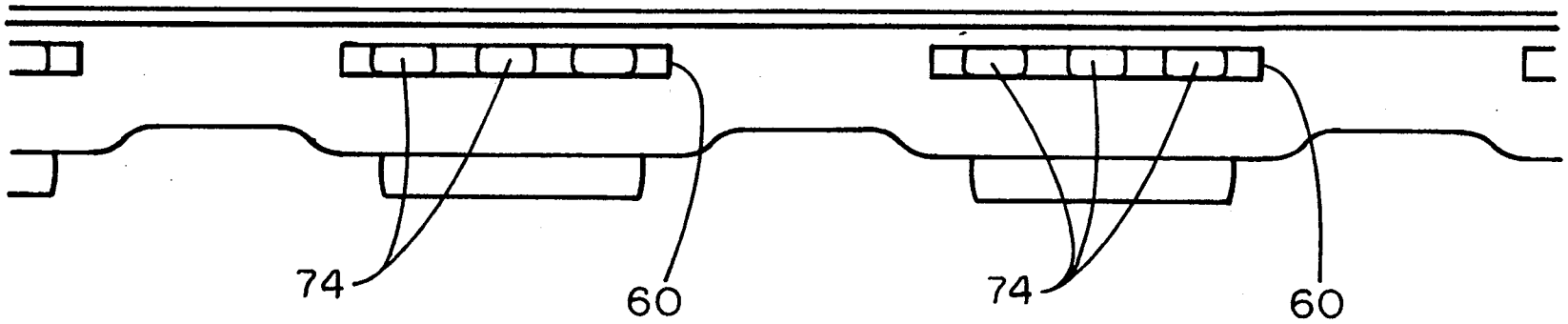
FIG. 6 is a sectional view taken along lines 6—6 of FIG. 5.

The preferred embodiment is shown in FIGS. 3, 5, 6 and 7 which basically is a fully cast vane divided into three distinct regions, namely, the leading edge, the trailing edge and the side wall panels. The fully cast vane 50 is comprised of the pressure side wall 52, the suction side wall 54, the trailing edge 56 and the leading edge 58. The vane may be cast in two halves as shown in FIG. 4 and bonded together by any suitable means, such as by transient liquid phase which is a well known joining process and then brazed to a suitable platform in a precision die, also a well known technique. The ends of rib portions 61 and 63 extending inwardly mate when assembled to form a structural rib to prevent the vane from bulging due to the aerodynamic and pressure loads. Each side wall, i.e. the pressure side wall 52 and suction side wall 54, are cast with a plurality of pockets 60 (see FIGS. 5 and 6) that are judiciously located adjacent the outer surface. A slot 62 is formed at the end of each pocket for exiting film air adjacent the outer surface of the side walls. A plurality of holes 64 are drilled internally of the pocket and communicate with the central passages 66 or 68 formed in the vane. The holes 64 are judiciously located so that cooling air impinges on the back side of the side wall, turns and flows toward the leading edge in the diffusing passageway or channel 70 and is further turned as it exits out of slot 62 and effectively producing a film of cooling air in the direction of the trailing edge. Each pocket includes pedestals 74 consistent with each application to enhance heat transfer.

In the preferred embodiment the fully cast vane 50 includes inserts or impingement tubes 76 and 78 similar to the impingement tubes shown in the prior art (FIGS. 1 and 2). A plurality of holes 80 in the walls of the impingement tubes 76 and 78 serve to feed the side wall holes of the pockets with the cooling air from the compressor section.

As is apparent from the foregoing the direction of the flow in the diffusing channel 70 is counter to the gas path flow thus placing the flows in indirect counter flow heat exchange relationship. The cooling air from hole 64 impinging on the back wall of channel 70 is at a location where the metal temperatures of the vane and the film air are at their hottest values.

Figure 7:
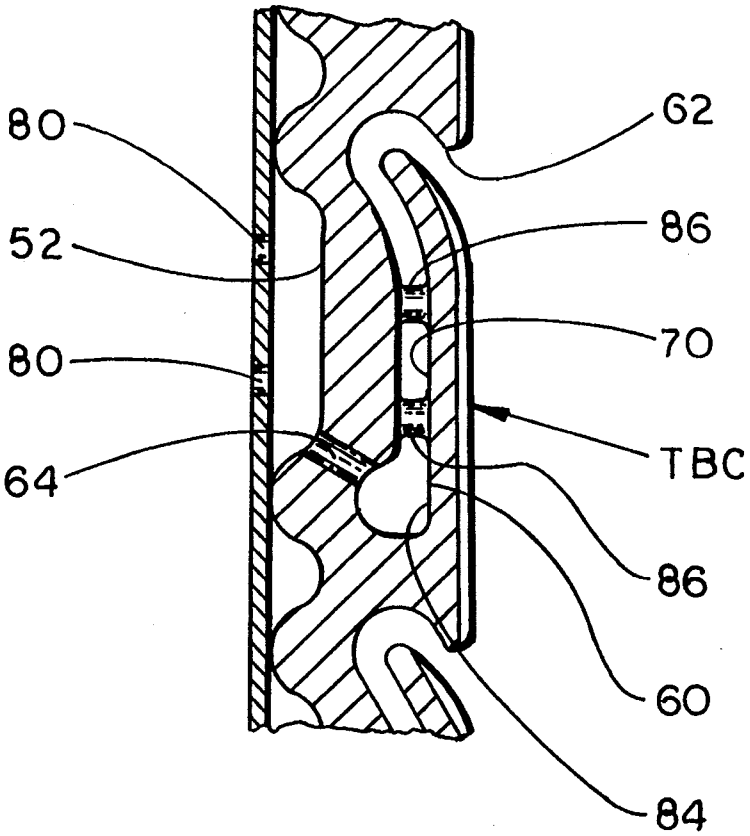
FIG. 7 is a partial view of an enlarged section of one of the pockets in FIG. 5.

As shown in FIG. 7 cool air from the impingement tube flows through holes 80 to impinge on the back surface of the side wall 52 effectuating impingement cooling and convection. The air then flows into the holes 64 to impinge on the back side of the wall 84 defining the pocket 60, flows through channel 70, turns 180° and exits through slot 62 to likewise maximize cooling effectiveness. The air discharges from diffusing channel 70 and slot 62, flows a film of cooling air over the surface of the vane in the direction of the trailing edge. Conventional pedestals 86 are included within the diffusing channel to enhance heat transfer.

In this design the leading edge 32 and trailing edge 38 are cooled utilizing conventional technique although in certain embodiments as will be understood from the description to follow, the side walls are fed with cool air directly from the central passage in the vane.

The airfoil section of the fully cast vane 50 can be coated with a thermal barrier coating similar to that used on the prior art vane as shown by the overlay 90. Since the slot is of a magnitude larger than those that are conventional in heretofore known vanes, the coating process doesn't adversely affect the cooling process.

What has been shown by this invention is a vane construction that effectively cools the vane utilizing less cooling air than heretofore known vanes. The inventive vanes are configured such that cooling is divided into three distinct regions; namely the leading edge, the trailing edge and the sidewall panels. Also, these configurations combine backside impingement cooling, convection, surface liner backside impingement, a diffusing channel and metering slot discharging the coolant into the airfoil boundary layer with an optimum blowing parameter and placing the flows of the diffusion channel and gas path in indirect counter flow heat exchange relationship.

Although this invention has been shown and described with respect to detailed embodiments thereof, it will be understood by those skilled in the art that various changes in form and detail thereof may be made without departing from the spirit and scope of the claimed invention.

We claim:

1. A stator vane comprising an airfoil section having a chordwise direction including a cast wall shell having a plurality of discrete pockets extending over the surface of the suction side and pressure side of said airfoil section, each of said pockets including a passageway extending parallel to the flow of the engine's gas path, an impingement hole at one end of said passageway extending through a portion of said cast wall shell and communicating with a central passage centrally disposed internal of said cast wall shell for flowing cooling air from said central passage through said impingement hole and through said passageway in a chordwise direction to discharge into said gas path through a slot formed on the end of said passageway to coalesce the cooling air for flowing a film of cooling air to flow along the outer surface of said cast wall shell in a direction of the gas path whereby said film of cooling air cools said stator vane, said flow of cooling air in said passageway being in indirect counterflow heat exchange relationship with said gas path.

2. For a gas turbine engine as claimed in claim 1 wherein said impingement hole is angularly disposed relative to said passageway, the flow egressing from said impingement hole being in a direction downstream relative to said gas path, wall means defining said passageway also defining a turning surface for the flow egressing from said impingement hole to turn in the opposite direction as said gas path and be in counter flow relationship thereto.

3. For a gas turbine engine as claimed in claim 2 wherein said air cooled vane includes an upper end and a lower end, each end being opened and in communication with the engine's cooling air, impingement tube inserts in said central passage for distributing cooling air to said impingement hole.

4. For a gas turbine engine as claimed in claim 3 including means for disrupting the flow in said passageway for enhancing heat transfer.

5. For a gas turbine engine as claimed in claim 4 wherein said flow disrupting means includes a pedestal.

6. For a gas turbine engine as claimed in claim 3 wherein said pockets are disposed in rows traversing said suction side and said pressure side and the pockets in alternate rows are staggered from the pockets in the preceding row.

7. For a gas turbine engine as claimed in claim 2 including an inwardly bent tip formed on the end of said passageway and defining a ramp for flowing the cool air around said tip to egress into said gas path.

* * * * *